US011577871B2

(12) United States Patent
Jönsson

(10) Patent No.: US 11,577,871 B2
(45) Date of Patent: Feb. 14, 2023

(54) SUPPORT PLATE FOR A PACKAGE SUITABLE FOR A FOOD PRODUCT

(71) Applicant: Tetra Laval Holdings & Finance S.A., Pully (CH)

(72) Inventor: Joel Jönsson, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 696 days.

(21) Appl. No.: 16/322,868

(22) PCT Filed: Jul. 31, 2017

(86) PCT No.: PCT/EP2017/069344
§ 371 (c)(1),
(2) Date: Feb. 1, 2019

(87) PCT Pub. No.: WO2018/024685
PCT Pub. Date: Feb. 8, 2018

(65) Prior Publication Data

US 2021/0380295 A1 Dec. 9, 2021

(30) Foreign Application Priority Data

Aug. 4, 2016 (EP) ..... 16182847

(51) Int. Cl.
*B65B 43/54* (2006.01)
*B65B 51/00* (2006.01)
(Continued)

(52) U.S. Cl.
CPC ..... *B65B 43/54* (2013.01); *B65B 51/00* (2013.01); *B65B 55/08* (2013.01); *B65B 55/10* (2013.01)

(58) Field of Classification Search
None
See application file for complete search history.

(56) References Cited

U.S. PATENT DOCUMENTS 1,647,232 A * 11/1927 Kiefer ..... B65B 3/16 141/86
2,574,157 A * 11/1951 Reichert ..... B65B 3/16 279/66

(Continued)

FOREIGN PATENT DOCUMENTS

JP S59-19599 2/1984
JP S 61-144008 9/1986

(Continued)

OTHER PUBLICATIONS

Extended European Search Report received in EP Application No. 16182847.0 dated Feb. 15, 2017.

*Primary Examiner* — Hemant Desai
*Assistant Examiner* — Tanzim Imam
(74) *Attorney, Agent, or Firm* — Knobbe, Martens, Olson & Bear, LLP

(57) ABSTRACT

A support plate for supporting a package during filling with a food product is disclosed. The support plate can include a wall defining a cavity for receiving a top portion of the package. The wall has a slanted interior surface that is complementary to the top portion of the package. The support plate also comprises a support projection extending in a parallel direction to and away from the wall, the support projection being complementary to and for abutting the top portion of the package, wherein the top portion can include a concave top surface and a second concave surface. A system that can include the support plate for use in a filling machine and a filling machine that can include a plurality of the systems are also disclosed.

16 Claims, 5 Drawing Sheets

(51) Int. Cl.
*B65B 55/10* (2006.01)
*B65B 55/08* (2006.01)

(56) References Cited

U.S. PATENT DOCUMENTS 2,698,076 A * 12/1954 Nilsson ..... B65B 3/16 198/803.11
2,725,169 A * 11/1955 Stigler ..... B65B 43/60 141/146
2,767,744 A * 10/1956 Beerman ..... B65D 71/502 141/330
2,987,082 A * 6/1961 Schaub ..... B65B 39/004 141/141
3,052,340 A 9/1962 Lyons et al.
3,147,018 A * 9/1964 Reichert ..... B65B 3/16 279/35
3,199,552 A * 8/1965 Nordfors ..... B65B 43/54 141/369
3,248,120 A * 4/1966 Volpe ..... B65B 43/54 279/151
3,390,891 A * 7/1968 Stichhan ..... B65B 3/16 279/23.1
3,480,049 A * 11/1969 Sadao ..... B65B 43/50 141/141
3,538,997 A * 11/1970 Christine ..... B65G 17/32 198/803.15
3,587,671 A * 6/1971 Gamberini ..... B65B 43/58 141/67
3,675,759 A * 7/1972 Koppe ..... B65B 43/54 198/867.08
4,114,511 A * 9/1978 Patenaude ..... F42B 39/08 89/35.01
4,533,038 A * 8/1985 Richard ..... B65G 17/12 198/803.15
4,564,139 A 1/1986 Reil
5,484,052 A * 1/1996 Pawloski ..... B67C 3/24 198/803.14
5,853,077 A * 12/1998 Schmitt ..... B65B 37/12 198/383
5,938,107 A 8/1999 Anchor et al.
5,975,158 A 11/1999 Gordon
2002/0099467 A1 7/2002 Sleep et al.
2003/0154694 A1* 8/2003 Peronek ..... B67C 3/242 53/490
2012/0024673 A1* 2/2012 Paskell ..... B65G 17/002 198/803.14
2012/0085418 A1* 4/2012 Apparuti ..... B65B 55/10 137/561 R
2013/0105038 A1* 5/2013 Swanson ..... B65B 43/52 141/1
2015/0166212 A1* 6/2015 Wissner ..... B65D 1/36 206/565
2017/0183113 A1* 6/2017 Deutschle ..... G01G 17/06
2021/0380296 A1 12/2021 Jonsson

FOREIGN PATENT DOCUMENTS

JP H 05-54326 7/1993
JP H 08-217023 8/1996
JP 2003-341620 12/2003
JP 2004-059014 2/2004
JP 2005-008268 1/2005
JP 2012-134026 1/2005
JP 2007-320646 12/2007
JP 2008-074482 4/2008
JP 2009-286499 12/2009
JP 2010235206 A * 10/2010 ..... B65B 55/10
JP 2013-112374 6/2013
JP 2015-020762 2/2015
WO WO 2005/087628 9/2005
WO WO 2008/004932 1/2008

* cited by examiner

SUPPORT PLATE FOR A PACKAGE SUITABLE FOR A FOOD PRODUCT

TECHNICAL FIELD

The present invention relates to a support plate for a package suitable for containing a food product. The present invention also relates to a system comprising the support plate and a filling machine comprising the system.

BACKGROUND

Packaging containers for food products are well known. One type of package known as a Tetra Top® package has a top portion with a closure (such as a screw cap) surrounded by convex or straight surfaces extending out and down towards four vertical side walls. During a filling operation this type of package is held with the closure facing downwards before the package is filled with a food product from above and through the opposing end of the package i.e. the end that eventually forms the bottom of the package as understood by the consumer. The bottom portion is then sealed and the filled package is removed from the filling operation.

More recent packages include a concave surface on their top portion and a concave surface elsewhere on the package such as at an edge between two of the adjacent vertical walls. A concave surface and a concave edge have an aesthetically pleasing appearance and may function as a thumb grip for the user when the food product is poured from the package. Unfortunately, packages with a concave surface on their top portion and a concave edge tend to rotate or twist during filling operations. This leads to incomplete package filling and stoppages in filling operations.

WO 2015/086362 discloses a package carrier for a tetrahedral-shaped package. However, such package carrier is unsuitable for use with packages having a top portion with a concave surface. The WO 2015/086362 package carrier is also unsuitable for use with packages having a concave surface at another location of the package such as an edge between adjacent side walls.

Thus, there is a need for improving the filling of packages with a concave top surface and a concave surface elsewhere on the package.

SUMMARY

According to a first aspect, there is provided a support plate for supporting a package during filling with a food product, the support plate comprising:

a wall defining a cavity for receiving a top portion of the package;

the wall having a slanted interior surface that is complementary to the top portion of the package; and a support projection extending in a parallel direction to and away from the wall, the support projection being complementary to and for abutting the top portion comprising a concave top surface and a concave surface of the package.

According to a second aspect, there is provided a system for use in a filling machine, the system comprising:

a package guide; and a support plate according to the first aspect above for supporting a package during filling with a food product;

wherein the support plate is mounted on the package guide and the package guide is configured for receiving the package.

According to a third aspect, there is provided a filling machine comprising:

a rotating support;

a plurality of systems according to the second aspect above mounted on the rotating support; and a filling station for filling a package with a food product when the package is being supported by the support plate of each system.

BRIEF DESCRIPTION OF DRAWINGS

Some preferred, non-limiting embodiments of the present invention will be described by way of example with reference to the accompanying drawings, in which.

DETAILED DESCRIPTION

Figure 1A:
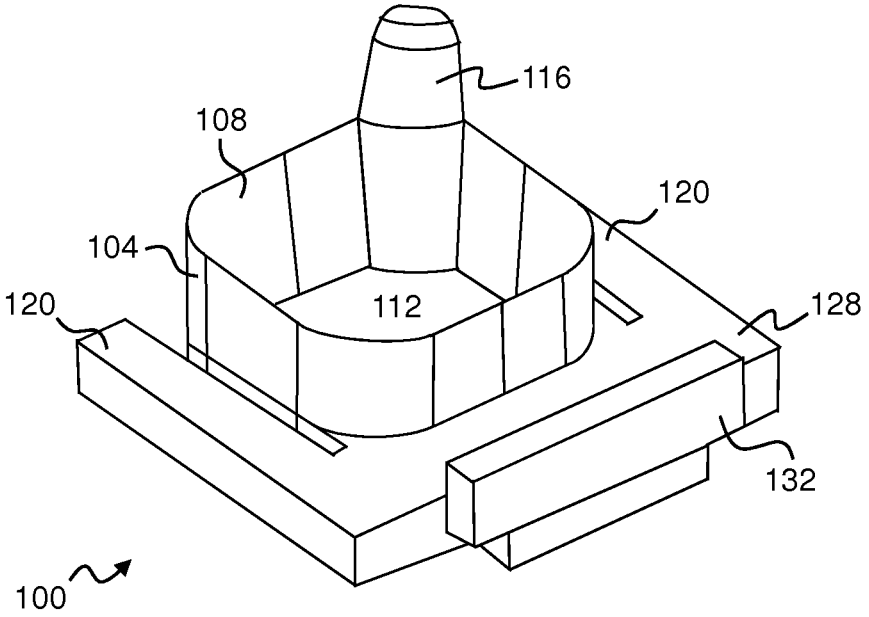
FIG. 1A illustrates a support plate according to an embodiment.

The table below lists various features and their respective reference numerals of the embodiments that will be described below with reference to the figures.

| Feature | Reference numeral |
|---|---|
| Support plate(s) | 100, 150 |
| Wall | 104, 154 |
| Slanted interior surface | 108, 158 |
| Cavity | 112, 162 |
| Support projection | 116, 166 |
| Clip member | 120, 170 |
| Clip recess | 174 |
| Connecting portion | 128, 178 |
| Grip member | 132, 182 |
| Package | 200 |
| Lateral walls | 204 |
| Concave surface | 208 |
| Convex top wall | 212 |
| Concave top surface | 216 |
| Closure | 220 |
| Sealing ring | 224 |
| Package guide | 300 |
| Support ridges | 304 |
| Viewing hole | 308 |
| Bevelled end | 312 |
| System | 320 |
| Filling machine | 400 |
| Rotating support | 404 |
| Sterilizer | 408 |

Figure 1B:
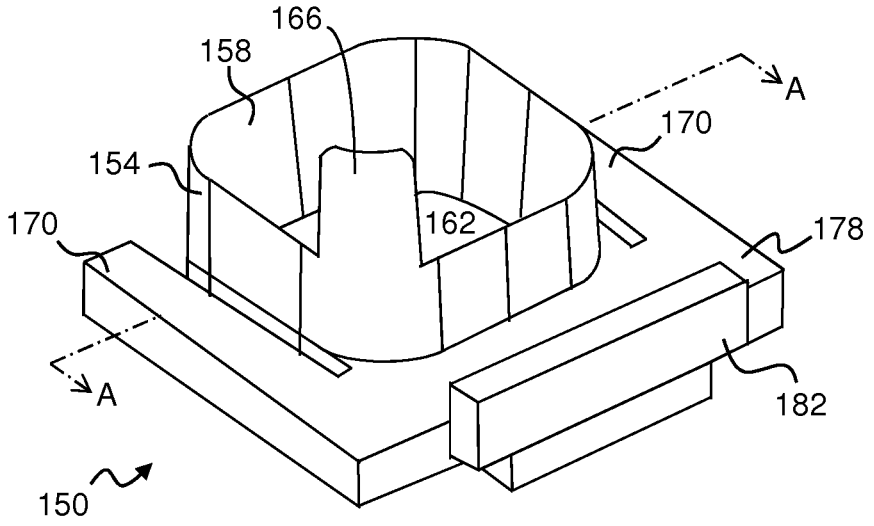
FIG. 1B illustrates another support plate according to an embodiment.
Figure 2:
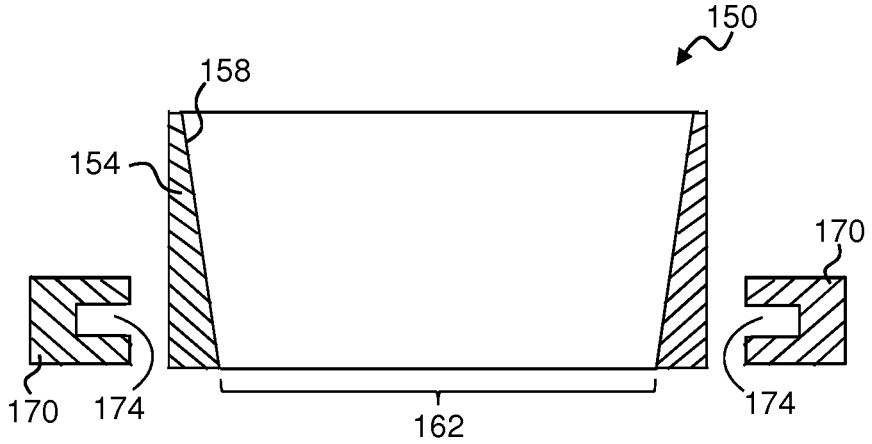
FIG. 2 is a cross-sectional view of the support plate in FIG. 1B along line A-A.

FIGS. 1A and 1B illustrate support plates 100 and 150 respectively that are suitable for use with the package depicted in FIGS. 3A and 3B that will be described below. Support plates 100 and 150 each comprise a wall 104, 154 surrounding a cavity 112, 162. Walls 104 and 154 have a slanted interior surface 108, 158 which is best shown in FIG. 2 in respect of support plate 150. A support projection 116, 166 extends vertically upwards to and from walls 104 and 154. Clip members 120, 170 are located at opposing ends of an approximately rectangular-shaped connecting portion 128, 178. Each clip 120, 170 has a clip recess 174 as depicted in FIG. 2. A grip member 132, 182 is located on a longitudinal side of the connecting portion 128, 178. The grip member 132, 182 is configured for engaging with an automated arm (not shown) of a filling machine in order to move the support plate to a different height or location as necessary. The support plates 100, 150 are injection moulded from plastic such as polyoxymethylene (POM) or polyoxyethylene. Preferably, the plastic is resistant to hydrogen peroxide solutions and/or UV light as used during sterilisation of the packages in a filling machine or process.

The location of support projections 116 and 166 on walls 104 and 154 is the sole difference between support plates 100 and 150. Both plates 100 and 150 may be used in a filling machine depending on the location of the plate in the filling machine and the orientation of the package to be used with the plate 100, 150. Although the support projections 116 and 166 are illustrated in one corner of walls 104 and 154, they need not be located in the wall corner. For example, the support projections 116 and 166 could be located on the side of the walls 104 and 154 i.e. between two adjacent corners of the walls 104 and 154.

The slanted interior surfaces 108, 158 and the cavities 112, 162 are configured for receiving the top dome of a package. The shape of the support projections 116, 166 is complementary to a concave top surface and another concave surface (such as a concave edge) of a package in order that the projections 116, 166 are able to abut and support the concave top surface and the concave surface (e.g. concave edge). This will become clearer with respect to FIG. 4 below.

Figure 3A:
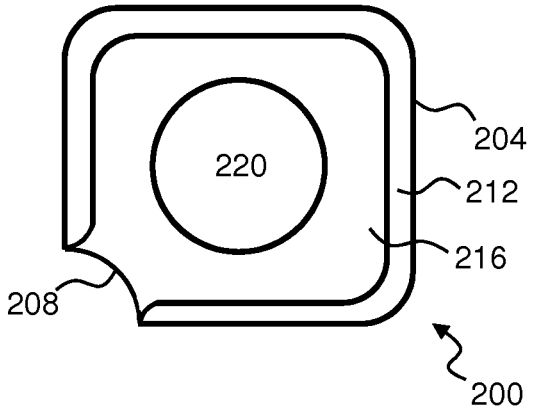
FIG. 3A is a top view of a package suitable for use with the support plates in FIGS. 1A and 1B.
Figure 3B:
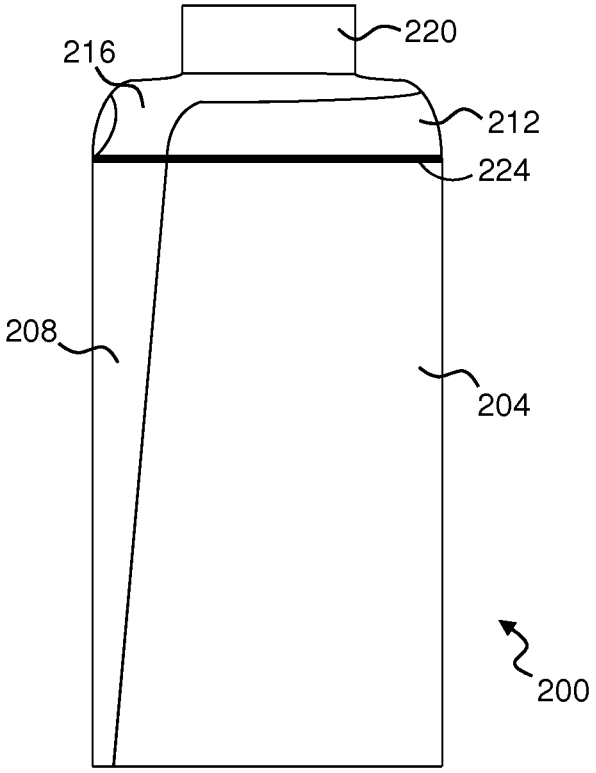
FIG. 3B is a front view of the package in FIG. 3A.

FIGS. 3A and 3B illustrate a package 200 suitable for use with the support plates 100 and 150 in FIGS. 1A and 1B. Package 200 has four lateral walls 204 and a concave surface 208 at an edge between two adjacent lateral walls 204. The top dome of package 200 comprises a convex top wall 212 and a concave top surface 216. A sealing ring 224 joins the top dome to the lateral walls 204 and the concave surface 208. A closure 220 atop the dome seals the package 200. The closure 220 may be a re-sealable screw cap or a peel-back lid.

Figure 4:
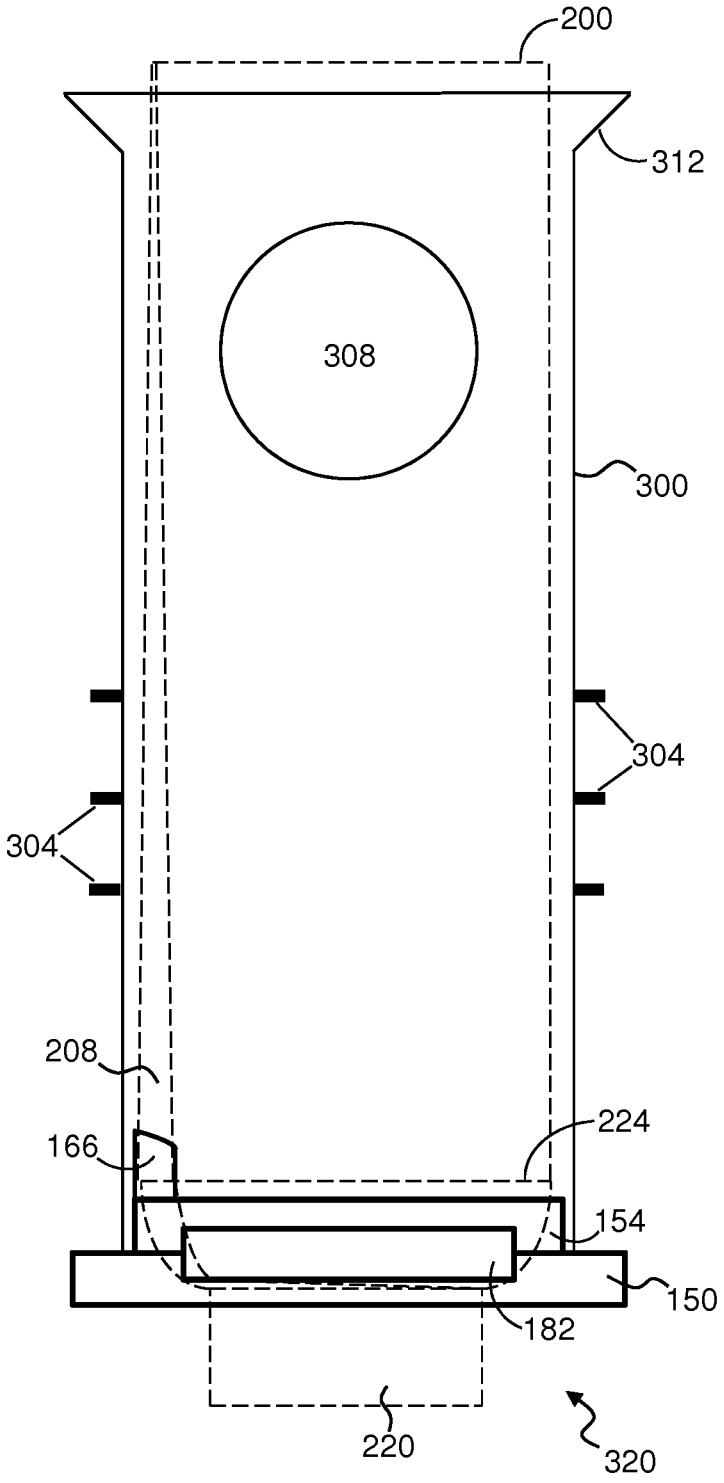
FIG. 4 is a front view illustrating a system comprising the support plate in FIG. 1B, the package in FIGS. 3A and 3B, and a package guide.

FIG. 4 illustrates a system 320 for use in a food product filling machine. System 320 comprises a package guide 300 and a support plate 150 as described in FIG. 1B mounted on the package guide 300. Of course, support plate 100 may be used instead of support plate 150 in system 320. The package guide 300 is configured for mounting to a rotating support (not shown) inside a filling machine.

Guide 300 is overall tubular in shape for receiving a package 200 as depicted with dashed lines. In use the package 200 enters guide 300 at bevelled end 312 and is lowered through guide 300 until the convex top wall 212 and the concave top surface 216 of the package's top dome rests on the complementary slanted interior surface 108, 158 of wall 104, 154. In this position the concave surface 208 of package 200 also rests against the support projection 116, 166 of support plate 100, 150. Once the package 200 is being supported by plate 100, 150 within the guide 300, the package is filled with a food product at the end opposing closure 220 prior to sealing what eventually becomes the bottom of the package 200.

Package guide 300 has a plurality of support ridges 304 located on external opposing faces of guide 300. The support ridges 304 are arranged in pairs wherein each member of a given pair is located at the same height on the guide 300. In this way a pair of ridges 304 is receivable by clip recesses 174 of clip members 120, 170. This allows adjustment of the support plate 100, 150 to a different height on the guide 300 depending on the volume of the package 200 that is to be filled. As mentioned above, the height of the support plate 100, 150 may be adjusted by cooperation between grip member 132, 182 and an automated arm (not shown).

A viewing hole 308 is also provided on package guide 300 for facilitating inspection of décor or other features of the package 200.

The package guide 300 is preferably made of metal.

Figure 5A:
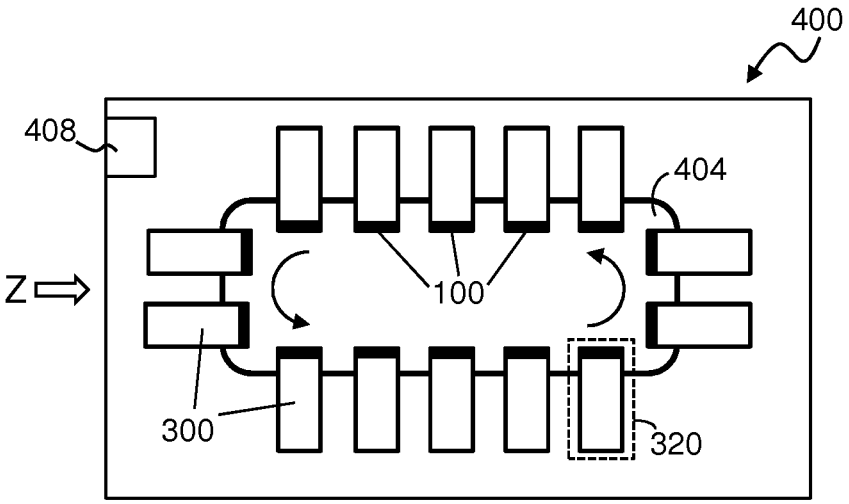
FIG. 5A is a front view of a filling machine according to an embodiment.
Figure 5B:
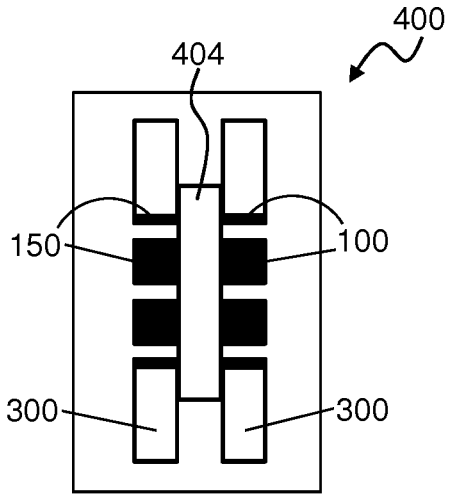
FIG. 5B is a side view of the filling machine from direction Z shown in FIG. 5A.

FIGS. 5A and 5B illustrate a filling machine 400 comprising a plurality of systems 320 mounted to a rotating support 404 that rotates in the direction of the arrows. Filling machine 400 also comprises a sterilizer 408 such as an ultra-violet lamp, a HEPA (high efficiency particulate air) purifier, and/or a hydrogen peroxide sprayer. Although not shown, the filling machine 400 may also comprise a package feeder for providing a package to the systems 320, a filling station for filling the package with a food product, and a sealing station for sealing the bottom of the package after filling. FIG. 5B depicts that one side of the filling machine may comprise systems 320 with support plates 100 while the opposing side may comprise systems 320 with support plates 150. This arrangement of supporting plates is suitable for use with a package feeder configured for providing packages 200 in one orientation only to all of the systems 320 in the filling machine 400. All concave surfaces 208 of packages 200 will be correctly orientated with support projections 116 and 166. Sterilizer 408 is omitted from FIG. 5B for clarity.

The support provided by projections 116 and 166 to the concave surface 208 and to the top dome of the package 200 (which includes concave top surface 216) prevents package 200 from rotating or twisting as well as helping to ensure the package 200 is held at the correct height during a filling operation. The support plates 100, 150 also absorb additional pressure generated on the package 200 during filling without damaging the package 200.

The support provided by projections 116 and 166 also allows for reducing or eliminating the requirement for a sealing ring 224 thereby improving the visual appearance of the package 200.

The invention claimed is:

1. A support plate configured to support a package while the package is being filled with a food product, the support plate comprising:
   - wall defining a cavity for receiving a top portion of the package and
   - having a slanted interior surface; and
   - a support projection extending in a direction parallel to and away from the wall, the support projection configured to abut the top portion of the package and to rest against a concave surface of the package.

2. The support plate of claim 1, further comprising a pair of clip members and a connecting portion, the clip members being located at opposing ends of the connecting portion.

3. The support plate of claim 2, wherein each clip member comprises a clip recess.

4. The support plate of claim 2, further comprising a grip member on a longitudinal side of the connecting portion.

5. The support plate of claim 1, wherein the support plate is injection molded from plastic.

6. The support plate of claim 1, further comprising a pair of clip members and a connecting portion, the clip members being located at opposing ends of the connecting portion, each clip member comprising a clip recess, the connecting portion comprising a grip member positioned on a longitudinal side of the connecting portion.

7. The support plate of claim 1, wherein the wall comprises a slanted interior portion, the wall configured to enclose the package.

8. A system for use in a filling machine, the system comprising:

a package guide; and the support plate of claim 1;

wherein the support plate is mounted on the package guide and the package guide is configured for receiving a package.

9. The system according to claim 8, further comprising a plurality of support ridges located on external opposing faces of the package guide- and a pair of clip members each comprising a clip recess, each support ridge being receivable by one of the clip recesses.

10. The system according to claim 8, wherein the package guide comprises a bevelled end.

11. The system according to claim 8, wherein the package guide comprises a viewing hole.

12. The system according to claim 8, wherein the package guide is made of metal.

13. A filling machine comprising:

a rotating support;

a plurality of the system of claim 8 mounted on the rotating support; and a filling station for filling a package with a food product when the package is being supported by the support plate of each system.

14. The filling machine of claim 13, further comprising a sterilizer selected from the group consisting of an ultraviolet lamp, a HEPA (high efficiency particulate air) purifier, and a hydrogen peroxide sprayer.

15. The filling machine of claim 13, further comprising a package feeder for providing a package to the plurality of systems.

16. The filling machine of claim 13, further comprising a sealing station for sealing a bottom of the package after filling the package with the food product.

* * * * *